US006469430B1

(12) United States Patent
Saita et al.

(10) Patent No.: US 6,469,430 B1
(45) Date of Patent: Oct. 22, 2002

(54) METHOD FOR REDUCING RESONANT FREQUENCY VIBRATIONS IN A CATHODE RAY TUBE

(75) Inventors: Koji Saita, Kanagawa; Tsunenari Saito, Tokyo; Tsuneo Muchi; Kenichi Ozawa, both of Kanagawa, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/286,833

(22) Filed: Apr. 6, 1999

Related U.S. Application Data

(62) Division of application No. 08/757,325, filed on Nov. 27, 1996, now abandoned.

(30) Foreign Application Priority Data

Nov. 30, 1995 (JP) ..... 7-312640

(51) Int. Cl.[7] ..... H01J 29/80
(52) U.S. Cl. ..... 313/404; 313/402; 445/30
(58) Field of Search ..... 313/402, 403, 313/404, 406, 405, 407, 408; 445/24, 25, 30, 3 A

(56) References Cited

U.S. PATENT DOCUMENTS 4,300,071 A * 11/1981 Dougherty et al. ..... 313/407
4,318,025 A 3/1982 Penird et al. ..... 313/402
4,367,430 A 1/1983 Matsushita et al. ..... 313/402
4,506,188 A 3/1985 Puhak ..... 313/402
4,798,992 A * 1/1989 Ichigaya et al. ..... 313/406
4,827,179 A * 5/1989 Adler et al. ..... 313/402
5,780,962 A 7/1998 Fujii et al. ..... 313/402
6,057,641 A * 5/2000 Yoshida et al. ..... 313/404

* cited by examiner

*Primary Examiner*—Vip Patel
*Assistant Examiner*—Joseph Williams
(74) *Attorney, Agent, or Firm*—Sonnenschein, Nath & Rosenthal

(57) ABSTRACT

A cathode ray tube including a color selecting, electrode having a plurality of metal tapes; a rectangular frame for holding the color selecting electrode under tension; a plate spring having one end fixed to the frame and the other end having an engaging hole; and a panel having a pin for engaging the engaging hole of the plate spring, the panel being held to the frame by the plate spring; wherein a resonance frequency of the plate spring is different from a resonance frequency of the metal tapes. Since the resonance frequency of the plate spring is different from the resonance frequency of the metal tapes, possible resonance of the metal tapes with a large amplitude by the vibrations of the plate spring due to external vibrations applied to the cathode ray tube can be prevented. Therefore, even though the color selecting electrode has a fine pitch with a large screen and a high definition, the cathode ray tube has vibration resistance to prevent color deviation or the like due to the vibrations.

16 Claims, 6 Drawing Sheets

METHOD FOR REDUCING RESONANT FREQUENCY VIBRATIONS IN A CATHODE RAY TUBE

This application is a division of U.S. appl Ser. No. 08/757,325, filed Nov. 27, 1996, now abandoned.

BACKGROUND OF THE INVENTION

The present invention relates to a cathode ray tube, and more particularly to a cathode ray tube having a. color selecting electrode.

A recent remarkable trend on the screen of a television receiver or the like is that the screen has become flat and large-sized, and that the definition of the screen has become high. In association with this trend, a plurality of metal tapes of a color selecting electrode constituting a part of a cathode ray tube used in the television receiver have become narrow in width and fine in pitch. Vibrations of the metal tapes constituting the color selecting electrode cause displacements of electron beams emitted from an electron gun provided in the cathode ray tube, causing color deviation. This phenomenon is remarkable particularly in a color selecting electrode having fine-pitched metal tapes. In general, a frame in the cathode ray tube is supported to a panel by four plate springs. The configuration of such a conventional cathode ray tube will now be described with reference to FIGS. 4 to 6.

FIG. 4 is a schematic sectional side view of a cathode ray tube 1, FIG. 5 is a schematic perspective view of a color selecting electrode 7 supported to a frame 3, and FIG. 6 is a schematic elevational view of the frame 3 supported to a panel 2*a*.

As shown in FIGS. 4 to 6, the cathode ray tube 1 is composed generally of an integral glass tube consisting of a panel 2*a*, a funnel 2*b*, and a neck portion 2*c*, a rectangular frame 3 located inside the panel 2*a*, for supporting a color selecting electrode 7 of a thin sheet metal under tension, and an electron gun 6 located in the neck portion 2*c*. Four holders 8 are fixed at their one end to the outer side surface of the frame 3, and four plate springs 4 are fixed at one end to the other ends of the four holders 8, respectively. Each plate spring 4 is formed at its other end with an engaging hole 4a. The engaging holes 4*a* of the plate springs 4 are respectively engaged with four pins 5 provided on a skirt portion of the panel 2*a*, thus holding the frame 3 to the panel 2*a*. The color selecting electrode 7 includes a plurality of metal tapes 7*a* and a plurality of slits 7*b*. The metal tapes 7*a* and the slits 7*b* are alternatively arranged. Each metal tape 7*a* is supported to the frame 3 under a given tension. The frame 3 is composed of a pair of longer side members 3*a* and a pair of shorter side members 3*b*, and the tension is applied between the longer side members 3*a*.

In many cases, a vibrating body such as a speaker is mounted in a television receiver or the like, and the vibration energy of the vibrating body is transmitted also to the color selecting electrode 7. In the case that the resonance frequency of the plate springs 4 supporting the frame 3 to the panel 2*a* (which will be hereinafter referred to simply as the resonance frequency of the plate springs 4) is equal or close to the resonance frequency of one of the plural metal tapes 7*a*, there is a possibility that the metal tape 7*a* whose resonance frequency is equal or close to the resonance frequency of the plate springs 4 may be resonated with a large amplitude, and also may vibrate the other peripheral metal tapes 7*a* and the entire color selecting electrode 7. As mentioned above, the vibrations of the metal tapes 7*a* cause color deviation due to the displacements of the electron beams emitted from the electron gun provided in the cathode ray tube. This phenomenon is remarkable particularly in the cathode ray tube 1 having the fine-pitched color selecting electrode 7 for a large screen with a high definition. Accordingly, making the resonance frequency of the plate springs 4 different from the resonance frequency of the metal tapes 7*a* is an important aspect in providing a cathode ray tube having vibration resistance.

SUMMARY OF THE INVENTION

It is accordingly an object of the present invention to provide a cathode ray tube having vibration resistance which can eliminate color deviation or the like.

According to the present invention, there is provided a cathode ray tube including a color selecting electrode having a plurality of metal tapes; a rectangular frame for holding the color selecting electrode under tension; a plate spring having one end fixed to the frame and the other end having an engaging hole; and a panel having means for engaging the engaging hole of the plate spring, the panel being held to the frame by the plate spring; wherein a resonance frequency of the plate spring is different from a resonance frequency of the metal tapes.

Preferably, the plate spring includes at least three plate springs for holding the panel to the frame. Further, the frame includes a pair of longer side members and a pair of shorter side members, and the tension is applied between the longer side members.

In the case of making the resonance frequency of the plate spring higher than the resonance frequency of the metal tapes, the plate spring preferably has a hardened film or a rib formed by drawing or bending so as to extend in a longitudinal direction of the plate spring. In the case of making the resonance frequency of the plate spring lower than the resonance frequency of the metal tapes, the plate spring preferably has a U-shaped bent portion, a V-shaped bent portion, a rectangular bent portion, a zigzag U-shaped bent portion, a zigzag V-shaped bent portion, or a zigzag rectangular bent portion.

The resonance frequency of the plate spring is different from the resonance frequency of the metal tapes constituting the color selecting electrode. Therefore, even when the cathode ray tube is vibrated by external vibration energy, there is no possibility that the metal tapes may be resonated with a large amplitude, so that it is possible to provide a cathode ray tube having vibration resistance which can eliminate color deviation or the like even though the color selecting electrode has a fine pitch with a high resolution.

Further, the resonance frequency of the plate spring can be set to a desired value by giving a suitable shape or the like to the plate spring. Accordingly, the cathode ray tube having vibration resistance can be easily manufactured.

Other objects and features of the invention will be more fully understood from the following detailed description and appended claims when taken with the accompanying drawings.

DETAILED DESCRIPTION OF THE PREFERRED EMBODIMENTS

Figure 4:
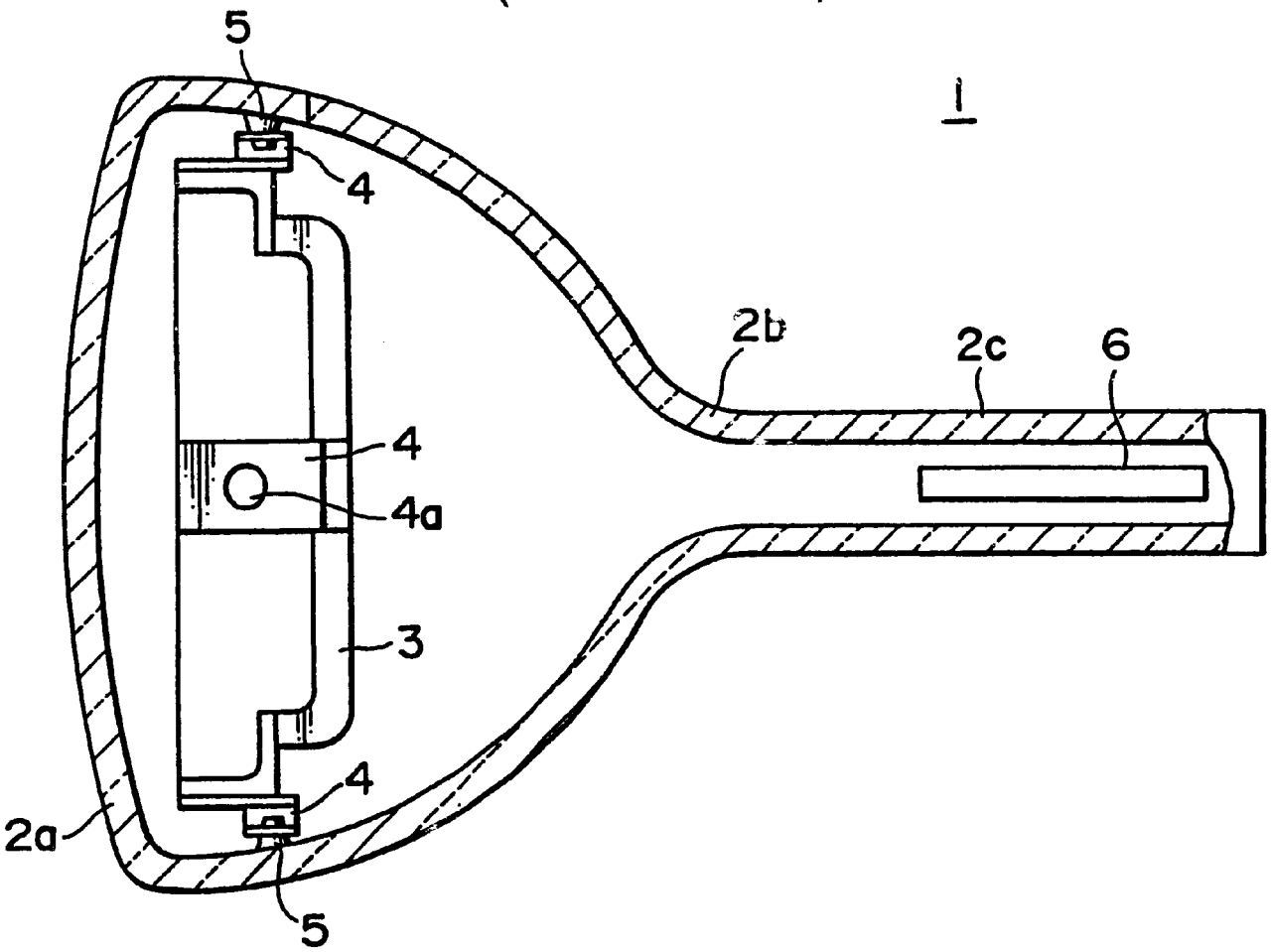
FIG. 4 (PRIOR ART)
FIG. 4 is a schematic sectional side view of a cathode ray tube in the related art.
Figure 5:
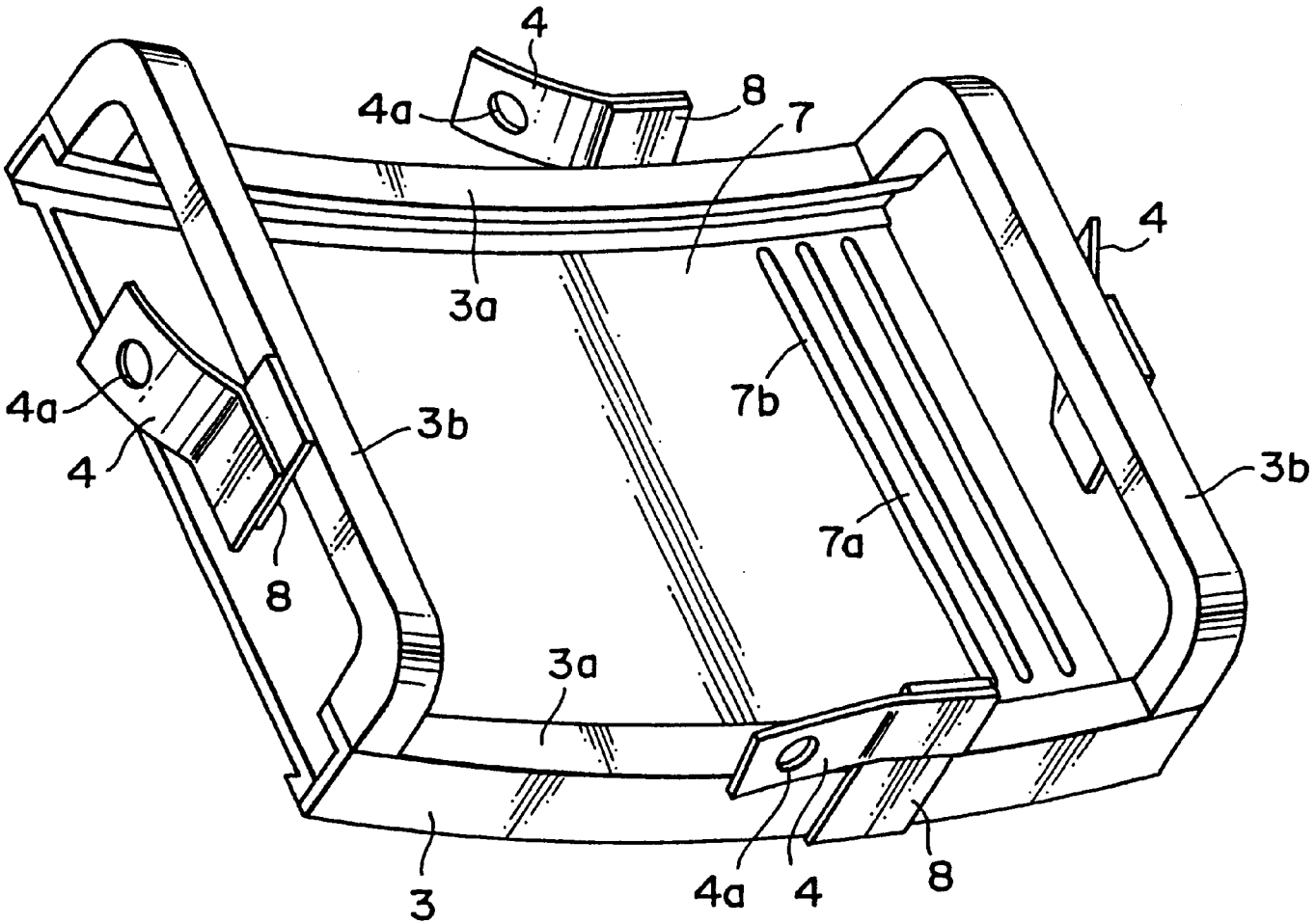
FIG. 5 (PRIOR ART)
FIG. 5 is a schematic perspective view of a color selecting electrode supported to a frame in the cathode ray tube shown in FIG. 4.
Figure 6:
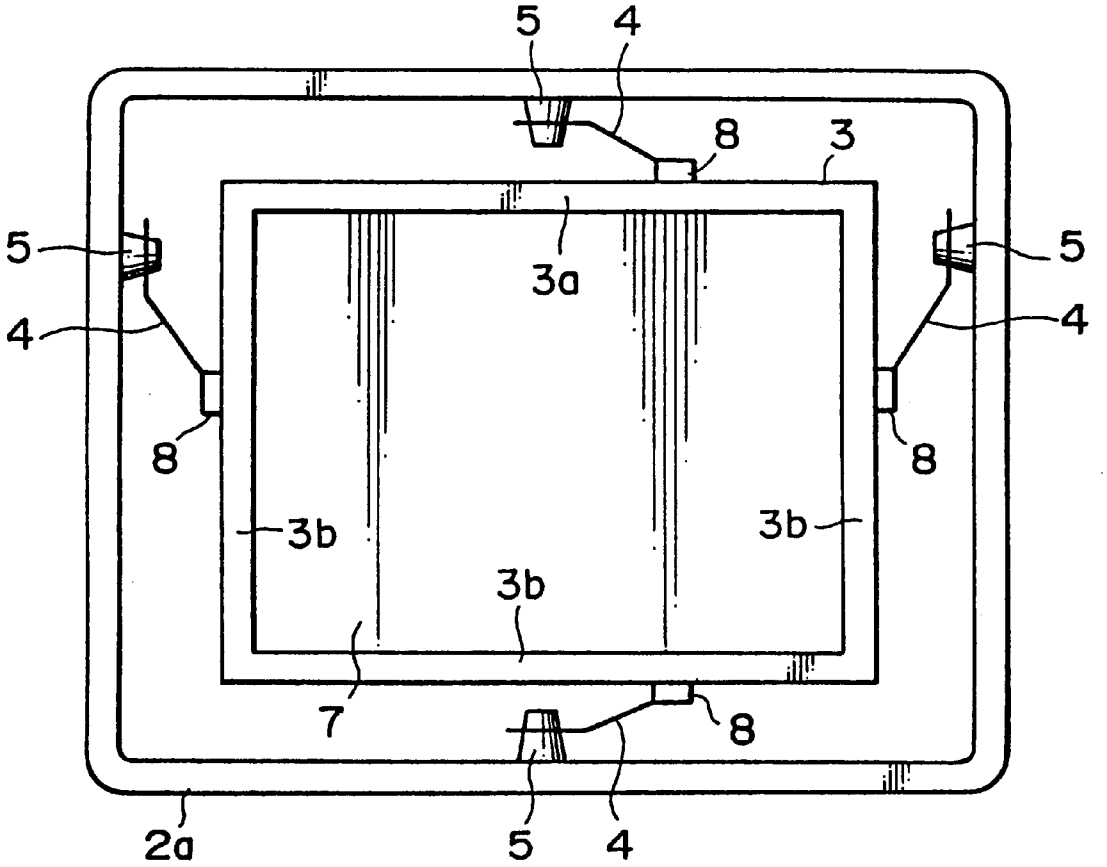
FIG. 6 (PRIOR ART)
FIG. 6 is a schematic elevational view of the frame supported to a panel in the cathode ray tube shown in FIG. 4.

Some preferred embodiments of the present invention will now be described with reference to FIGS. 1A to 3C. In these figures, substantially the same elements as those shown in FIGS. 4 to 6 are denoted by the same reference numerals.

(First Preferred Embodiment)

In the first preferred embodiment, the resonance frequency of the plate spring 4 is set higher than the resonance frequency of the metal tapes constituting the color selecting electrode. The first preferred embodiment will now be described with reference to FIGS. 1A to 1C.

Figure 1A:
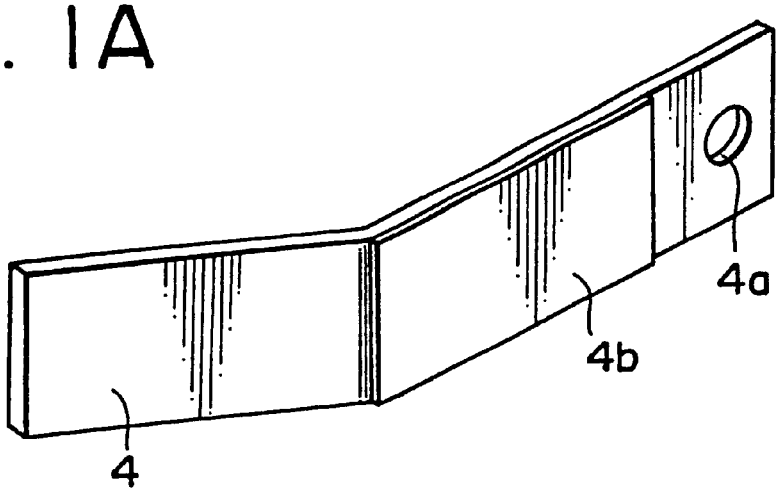
FIGS. 1A to 1C are schematic perspective views of plate springs having different shapes according to a first preferred embodiment of the present invention.

FIG. 1A is a schematic perspective view of an embodiment of the plate spring 4, wherein a hardened film 4*b* is formed on a part of one surface of the plate spring 4.

More specifically, the hardened film 4*b* is formed on a part of one surface of the plate spring 4 by thermal spraying of tungsten carbide or ceramics coating, for example. The spring constant of the plate spring 4 having the hardened film 4*b* can be made larger than that of a plate spring not having the hardened film 4*b*. Accordingly, the resonance frequency of the plate spring 4 can be set higher than that of the metal tapes.

While the hardened film 4*b* is formed on a part of one surface of the plate spring 4 in this embodiment, the hardened film 4*b* may be formed on the whole of one surface of the plate spring 4 or on the whole of both surfaces of the plate spring 4. In this case, the resonance frequency of the plate spring 4 can be set much higher than that of the metal tapes.

Figure 1B:
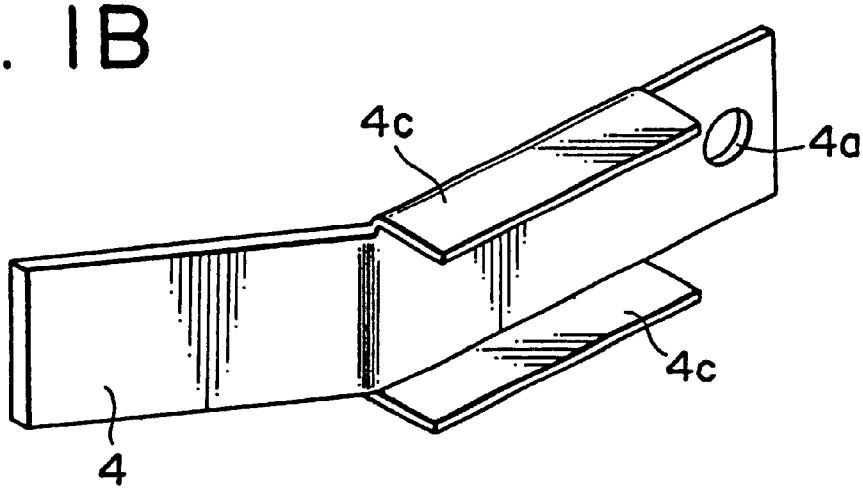

FIG. 1B is a schematic perspective view of another embodiment of the plate spring 4, wherein a pair of ribs 4*c* are formed integrally with the plate spring 4. That is, the pair of ribs 4*c* extend parallel to a longitudinal direction of the plate spring 4 and are bent at substantially right angles to one surface of the plate spring 4.

The spring constant of the plate spring 4 having the ribs 4*c* can be made larger than that of a plate spring not having the ribs 4*c*. Accordingly, the resonance frequency of the plate spring 4 can be set higher than that of the metal tapes.

Figure 1C:
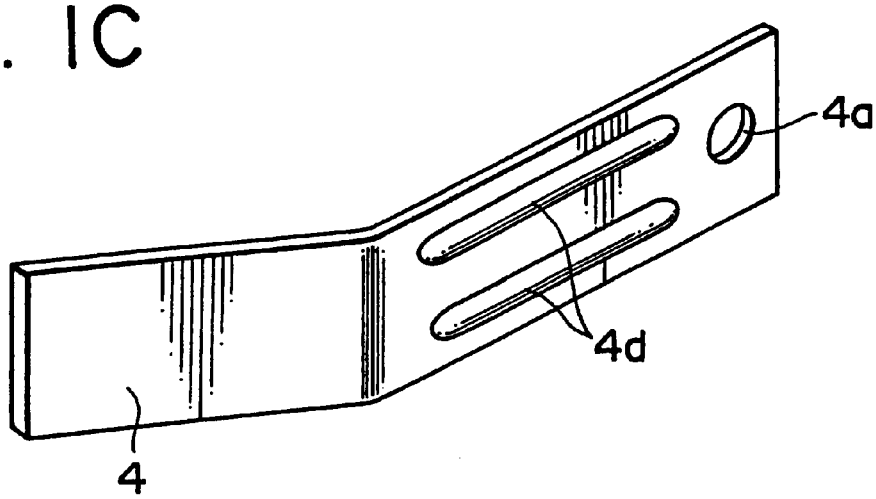

FIG. 1C is a schematic perspective view of a further embodiment of the plate spring 4, wherein a plurality of drawn ribs 4*d* are formed by pressing or the like on one surface of the plate spring 4 so as to extend in the longitudinal direction of the plate spring 4.

The spring constant of the plate spring 4 having the drawn ribs 4*d* can be made larger than that of a plate spring not having the drawn ribs 4*d*. Accordingly, the resonance frequency of the plate spring 4 can be set higher than that of the metal tapes.

According to the first preferred embodiment, the spring constant of the plate spring 4 can be made larger to thereby set the resonance frequency of the plate spring 4 higher than the resonance frequency of the metal tapes constituting the color selecting electrode. Therefore, even when the cathode ray tube is vibrated by external vibrations, there is no possibility that the metal tapes may be resonated by the plate springs with a large amplitude. Accordingly, it is possible to provide a cathode ray tube having vibration resistance which can eliminate color deviation or the like even though the color selecting electrode has a fine pitch with a large screen and a high resolution.

(Second Preferred Embodiment)

In the second preferred embodiment, the resonance frequency of the plate spring is set lower than that of the metal tapes constituting the color selecting electrode. The second preferred embodiment will now be described with reference to FIGS. 2A to 3C.

Figure 2A:
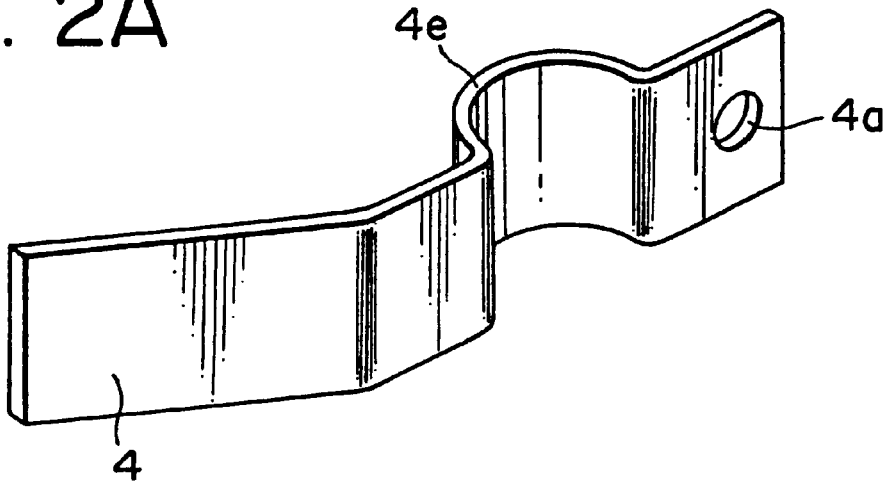
FIGS. 2A to 2C are schematic perspective views of plate springs having different shapes according to a second preferred embodiment of the present invention.

FIG. 2A is a schematic perspective view of an embodiment of the plate spring 4, wherein the plate spring 4 is formed with a U-shaped bent portion 4*e*.

The spring constant of the plate spring 4 having the U-shaped bent portion 4*e* can be made smaller than that of a plate spring not having the U-shaped bent portion 4*e*. Accordingly, the resonance frequency of the plate spring 4 can be set lower than that of the metal tapes.

Figure 2B:
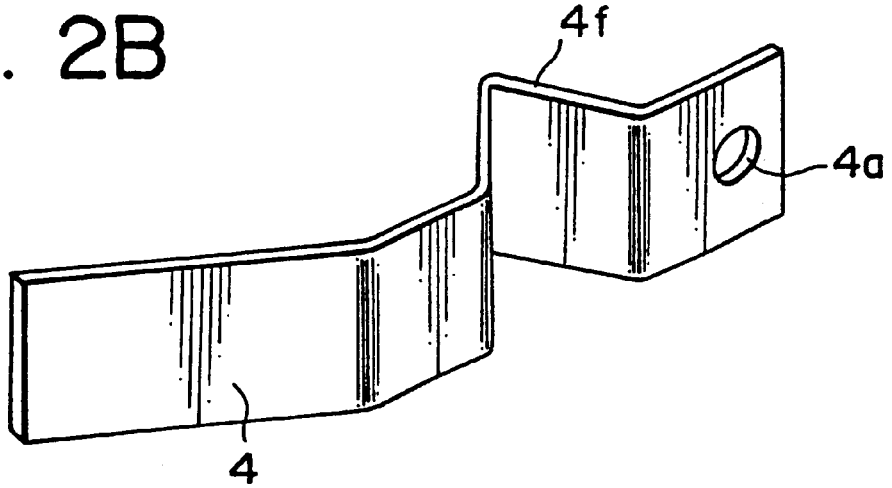

FIG. 2B is a schematic perspective view of another embodiment of the plate spring 4, wherein the plate spring 4 is formed with a V-shaped bent portion 4*f*.

The spring constant of the plate spring 4 having the V-shaped bent portion 4*f* can be made smaller than that of a plate spring not having the V-shaped bent portion 4*f*. Accordingly, the resonance frequency of the plate spring 4 can be set lower than that of the metal tapes.

Figure 2C:
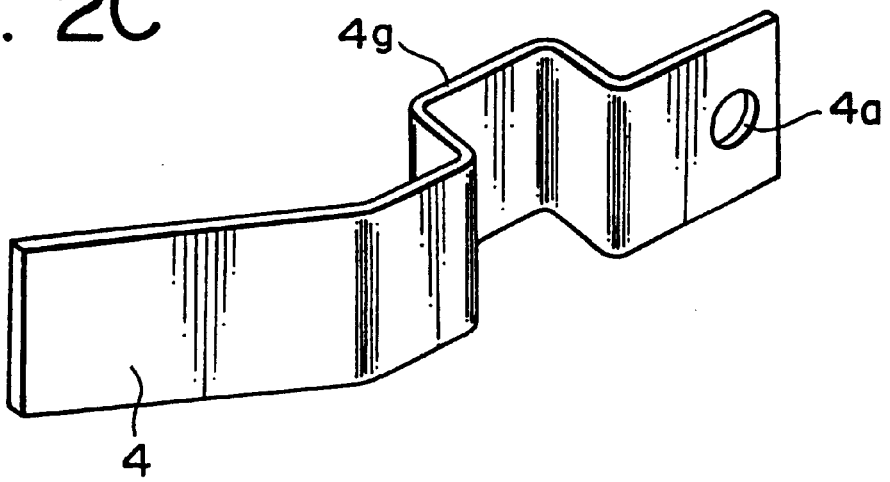

FIG. 2C is a schematic perspective view of a further embodiment of the plate spring 4, wherein the plate spring 4 is formed with a rectangular bent portion 4*g*.

The spring constant of the plate spring 4 having the rectangular bent portion 4*g* can be made smaller than that of a plate spring not having the rectangular bent portion 4*g*. Accordingly, the resonance frequency of the plate spring 4 can be set lower than that of the metal tapes.

Figure 3A:
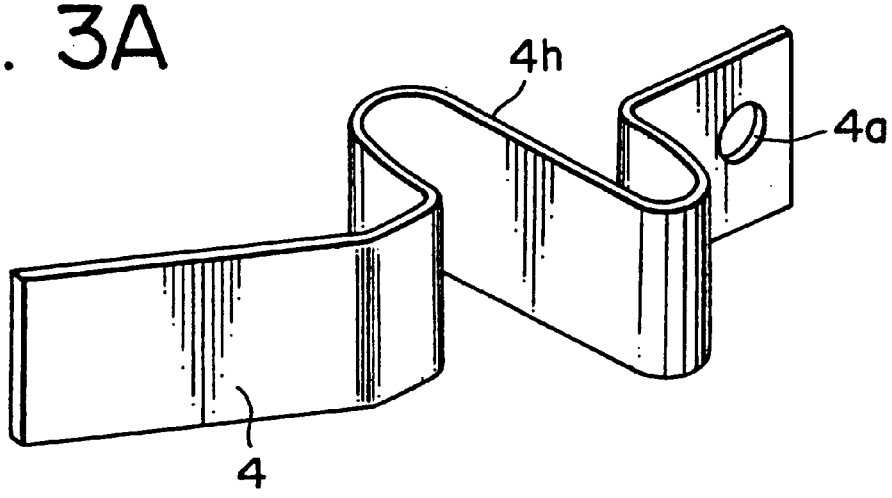
FIGS. 3A to 3C are schematic perspective views of plate springs having further different shapes according to the second preferred embodiment.

FIG. 3A is a schematic perspective view of a further embodiment of the plate spring 4, wherein the plate spring 4 is formed with a zigzag U-shaped bent portion 4*h*.

The spring constant of the plate spring 4 having the zigzag U-shaped bent portion 4*h* can be made smaller than that of a plate spring not having the zigzag U-shaped bent portion 4*h*. Accordingly, the resonance frequency of the plate spring 4 can be set lower than that of the metal tapes.

Figure 3B:
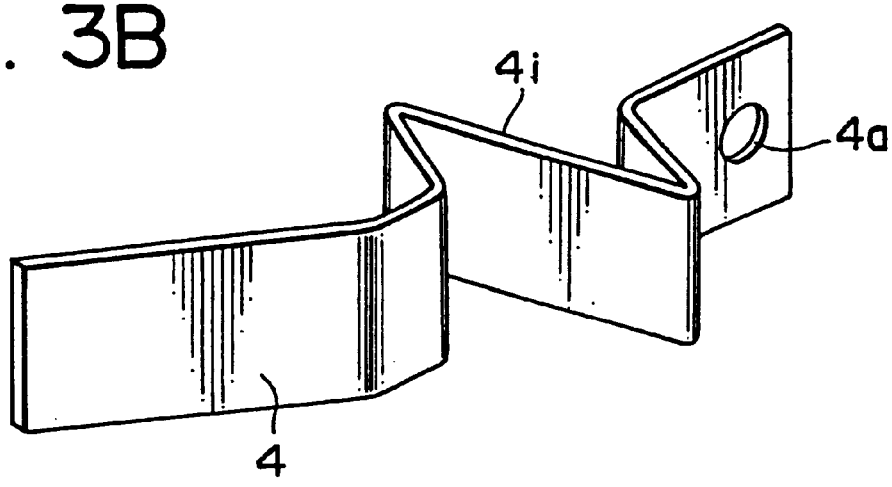

FIG. 3B is a schematic perspective view of a further embodiment of the plate spring 4, wherein the plate spring 4 is formed with a zigzag V-shaped bent portion 4*i*.

The spring constant of the plate spring 4 having the zigzag V-shaped bent portion 4*i* can be made smaller than that of a plate spring not having the zigzag V-shaped bent portion 4*i*. Accordingly, the resonance frequency of the plate spring 4 can be set lower than that of the metal tapes.

Figure 3C:
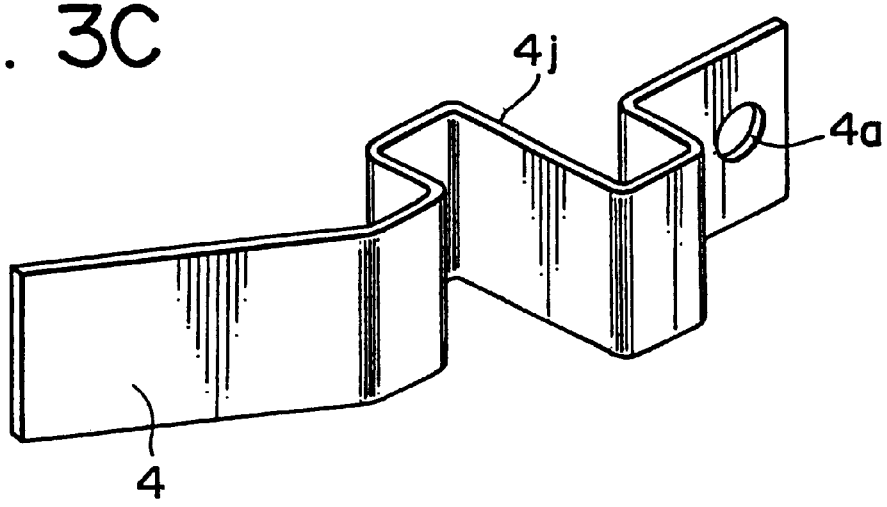

FIG. 3C is a schematic perspective view of a further embodiment of the plate spring 4, wherein the plate spring 4 is formed with a zigzag rectangular bent portion 4*j*.

The spring constant of the plate spring 4 having the zigzag rectangular bent portion 4*j* can be made smaller than that of a plate spring not having the zigzag rectangular bent portion 4*j*. Accordingly, the resonance frequency of the plate spring 4 can be set lower than that of the metal tapes.

According to the second preferred embodiment, the spring constant of the plate spring 4 can be made smaller to thereby set the resonance frequency of the plate spring 4 lower than the resonance frequency of the metal tapes constituting the color selecting electrode. Therefore, even when the cathode ray tube is vibrated by external vibrations, there is no possibility that the metal tapes may be resonated by the plate springs with a large amplitude. Accordingly, it is possible to provide a cathode ray tube having vibration resistance which can eliminate color deviation or the like even though the color selecting electrode has a fine pitch with a large screen and a high resolution.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A method for reducing vibration of metal tapes of a color selecting electrode in a cathode ray tube, comprising the steps of:

providing a color selecting electrode having a plurality of metal tapes;

holding said color selecting electrode under tension with a frame;

providing a plate spring having one end fixed to said frame and the other end having an engaging hole for engaging with a projection on a panel so as to fix said frame relative to said panel, said plate spring having a bend with respect to a longitudinal direction thereof, and said plate spring having a mechanism to (i) increase a spring constant of said plate spring, and (ii) give said plate spring a resonance frequency that is higher than that of said metal tapes.

2. The method according to claim 1 including the step of providing at least three plate springs holding said panel to said frame.

3. The method according to claim 1 including the steps of providing said frame with a pair of longer side members and a pair of shorter side members, and applying tension between the longer side members.

4. The method according to claim 1 including the step of forming a hardened film on said plate spring, and wherein said hardened film is said mechanism to increase said spring constant of said plate spring.

5. The method according to claim 1 including the step of forming a rib in the plate spring by drawing, said rib extending in said longitudinal direction of said plate spring, and wherein said rib is said mechanism to increase said spring constant of said plate spring.

6. The method according to claim 1 including the step of forming a drawn rib in said plate spring by bending, said drawn rib extending in said longitudinal direction of said plate spring, and wherein said drawn rib is said mechanism to increase said spring constant of said plate spring.

7. The method according to claim 4 wherein said hardened film is formed on said plate spring by thermal spraying of tungsten carbide or ceramics coating.

8. A method for reducing vibration of metal tapes of a color selecting electrode in a cathode ray tube, comprising the steps of:

providing a color selecting electrode having a plurality of metal tapes;

holding said color selecting electrode under tension with a rectangular frame;

providing a plate spring having one end fixed to said frame and the other end having an engaging hole for engaging with a projection on a panel so as to fix said frame relative to said panel, said plate spring having at least one bend perpendicular to a longitudinal direction thereof, and altering the shape of said plate spring between said bend and said engaging hole with respect to said longitudinal direction thereof to provide a lower spring constant therefor and for said plate spring to have a resonance frequency that is lower than that of said metal tapes.

9. The method according to claim 8 including the step of providing at least three plate springs holding said panel to said frame.

10. The method according to claim 8 including the steps of providing said frame with a pair of longer side members and a pair of shorter side members, and applying tension between the longer side members.

11. The method according to claim 8, wherein altering the shape of said plate spring between said bend and said engaging hole includes providing a U-shaped bend in said plate spring between said bend and said engaging hole.

12. The method according to claim 11, wherein said U-shaped bend is a zig-zag U-shaped bend.

13. The method according to claim 8, wherein altering the shape of said plate spring between said bend and said engaging hole includes providing a V-shaped bend in said plate spring between said bend and said engaging hole.

14. The method according to claim 13, wherein said V-shaped bend is a zig-zag V-shaped bend.

15. The method according to claim 8, wherein altering the shape of said plate spring between said bend and said engaging hole includes providing a rectangular bend in said plate spring between said bend and said engaging hole.

16. The method according to claim 15, wherein said rectangular bend is a zig-zag rectangular bend.

* * * * *